US006629629B2

(12) United States Patent
Lee et al.

(10) Patent No.: US 6,629,629 B2
(45) Date of Patent: Oct. 7, 2003

(54) SACK WITH DETACHABLE HARD CASE

(75) Inventors: Gi-Soo Lee, Gangnam-gu (KR); Eun-Sue Whi, Sungdong-go (KR)

(73) Assignee: Cypher Teams Co., Ltd. (KR)

( * ) Notice: Subject to any disclaimer, the term of this patent is extended or adjusted under 35 U.S.C. 154(b) by 0 days.

(21) Appl. No.: 09/899,515

(22) Filed: Jul. 5, 2001

(65) Prior Publication Data

US 2002/0017544 A1 Feb. 14, 2002

(30) Foreign Application Priority Data

Jul. 22, 2000 (KR) ..... 2000-0020978

(51) Int. Cl.[7] ..... A45C 15/00

(52) U.S. Cl. ..... 224/583; 224/629; 224/630; 224/652; 224/653; 224/659

(58) Field of Search ..... 224/628, 629, 224/630, 652, 653, 655, 659, 583

(56) References Cited

U.S. PATENT DOCUMENTS 4,673,070 A * 6/1987 Ambal ..... 150/111
5,628,443 A * 5/1997 Deutsch ..... 150/113
5,634,576 A * 6/1997 Arbel ..... 224/148.2
5,676,293 A * 10/1997 Farris ..... 2/175.7
5,676,296 A * 10/1997 Masters ..... 224/148.7
5,704,529 A * 1/1998 Santoro et al. ..... 224/242
5,729,869 A * 3/1998 Anscher ..... 224/272
5,732,867 A * 3/1998 Perkins et al. ..... 224/271
6,179,186 B1 * 1/2001 Blanking ..... 224/153
6,196,437 B1 * 3/2001 Smith III ..... 224/241
6,325,262 B1 * 12/2001 Thompson ..... 224/153

* cited by examiner

*Primary Examiner*—Stephen K. Cronin
(74) *Attorney, Agent, or Firm*—Cantor Colburn LLP

(57) ABSTRACT

The present invention disclose a sack used in an ordinary sack and a hard type sack selectively according to the existence of a hard case.

The ordinary sack can be sagged easily when goods is packed into the sack because a material of the sack is usually a soft synthetic fiber. Such softness gives a non-elegant and uncomfortable to carry the ordinary sack. In more, carrying fragile goods in such a sack can make someone to be nervous to prevent unpredicted external impact. Usage of the hard type sack has an advantage to keep a shape without sagging when goods are packed in, and to protect the goods from any external impact, because a backside case is made of a hard material. However, disassembling the backside case from the hard type sack is not easy because the backside case is jointed with a back supporter by bolts and nuts method. In more, bolts are always required to re-assemble the backside case into the hard type sack after disassembling. The sack according to the present invention provide assembling and disassembling the hard case conveniently, and easy carrying a separated hard case, which results in satisfying some portions of various needs and favorites of purchasers.

16 Claims, 4 Drawing Sheets

SACK WITH DETACHABLE HARD CASE

CROSS REFERENCE

This application claims the benefit of Korean Utility Patent Application No. 20-2000-0020978, filed on Jul. 22, 2000, under 35 U.S.C. §119, the entirety of which is hereby incorporated by reference.

BACKGROUND OF THE INVENTION

1. Field of the Invention

The present invention refers to a sack with a detachable hard case. In particular, a hard case is attached to the backside of the sack when heavy articles or fragile articles treated carefully are carried. The sack without the hard case can also be used.

2. Description of Related Art

In general, a sack is a kind of bags that is usually fastened on someone's shoulder to carry necessary goods conveniently and to protect the goods, especially in climbing, fishing, or traveling. According to usage of the sack, the sack is called by a rucksack, a knapsack, or a packsack, etc. Such a sack is commonly used to carry books and notebooks among students in these days, too. Such a popular usage makes the sack to be produced in various designs and colors to attract a purchaser.

The ordinary sack can be sagged easily when goods are packed in because a material of the ordinary sack is usually a soft synthetic fiber. Such softness gives a non-elegant and uncomfortable to carry the ordinary sack. In more, carrying fragile goods in such a sack can make someone to be nervous to prevent unpredicted external impact.

To improve the above mentioned problems, a hard type sack is presented, wherein a shoulder rack and a back supporter are made of a synthetic resin, for example, a polyester, and a backside case is made of a hard material. The hard type sack fixes rim of the backside case to each side and bottom of the back supporter by jointing bolts.

Usage of the hard type sack has an advantage to keep a shape without sagging when goods are packed in, and to protect the goods from any external impact, because the backside case is made of a hard material.

However, disassembling the backside case from the hard type sack is not easy because the backside case is jointed with the back supporter by bolts and nuts method. In more, bolts are always required to re-assemble the backside case into the hard type sack after disassembling.

SUMMARY OF THE INVENTION

To overcome the above described problems, preferred embodiments of the present invention provide a sack having a detachable hard case, wherein the detachable hard case can be attached to the backside of the sack. Therefore, the sack with the detachable hard case is used to carry heave or fragile goods like the hard type sack, and the sack without the detachable hard case is used like an ordinary sack.

Another preferred embodiments of the present invention can apply a protrusion-groove structure to equip the detachable hard case to the sack, and to separate the detachable hard case from the sack conveniently.

BRIEF DESCRIPTION OF THE DRAWINGS

For a more complete understanding of the present invention and the advantages thereof, reference is now made to the following descriptions taken in conjunction with the accompanying drawings, in which like reference numerals denote like parts, and in which.

DETAILED DESCRIPTION OF PREFERRED EMBODIMENTS

Reference will now be made in detail to preferred embodiments of the present invention, example of which is illustrated in the accompanying drawings.

Figure 1:
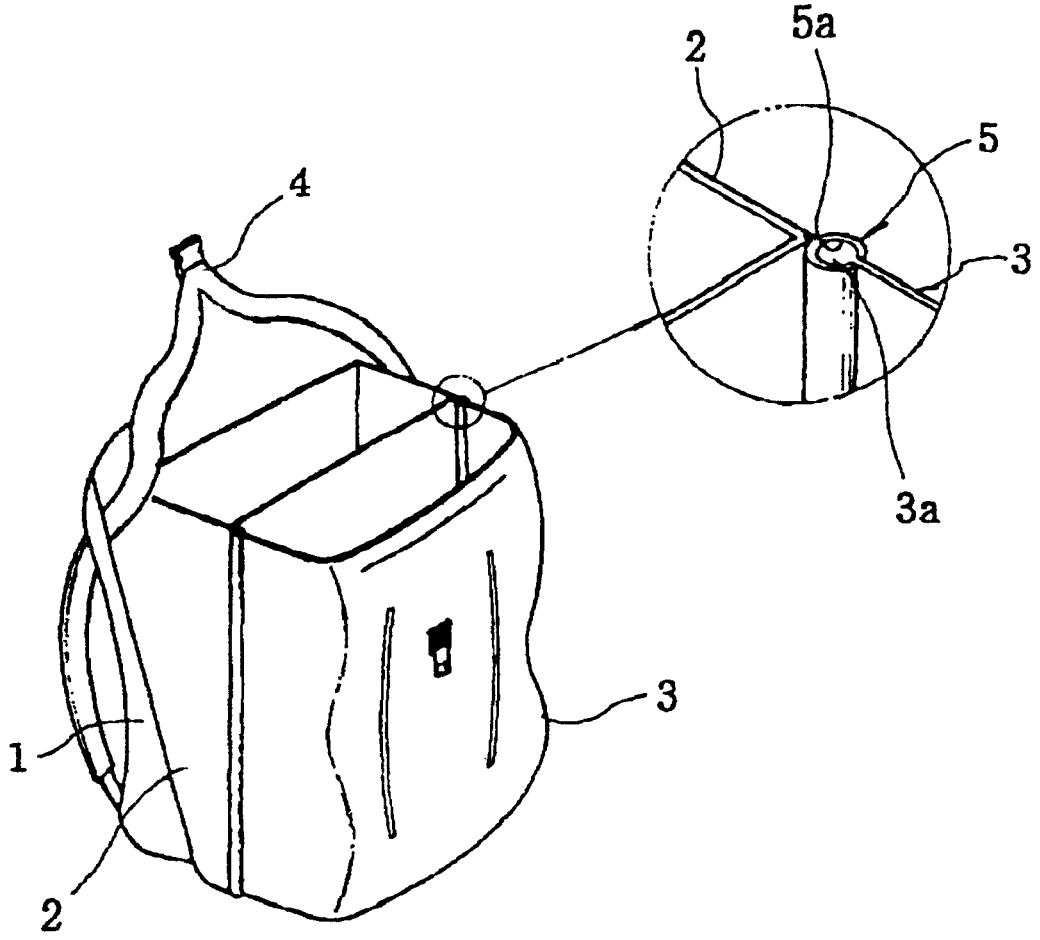
FIG. 1 is a perspective view of a sack with a detachable hard case according to the present invention.
Figure 2A:
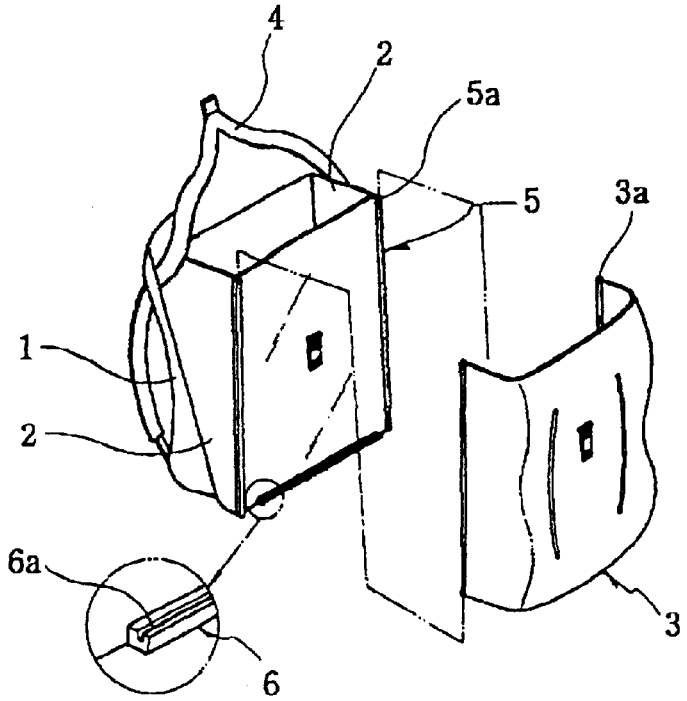
FIG. 2*a* and FIG. 2*b* are disassembled perspective views the sack with the detachable hard case according to the present invention.
Figure 2B:
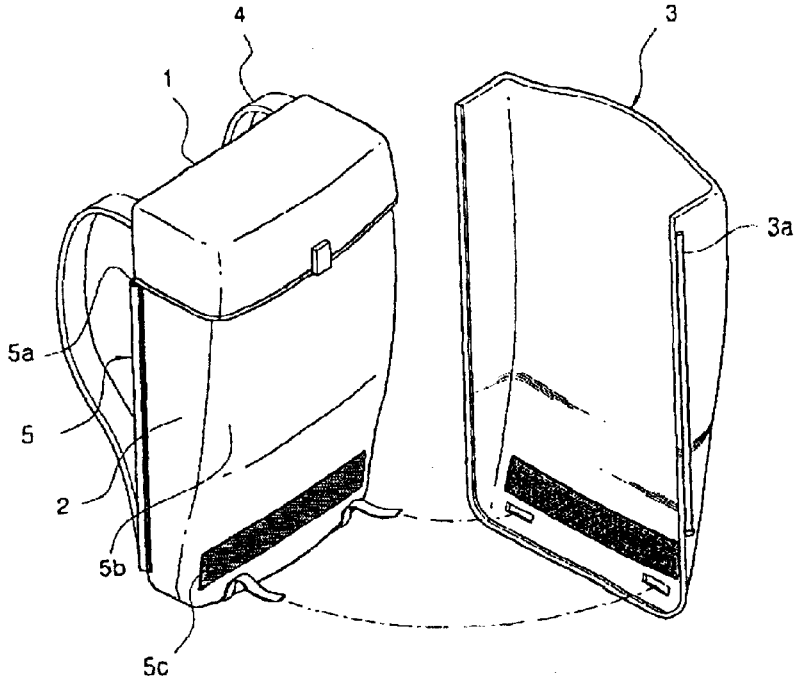
Figure 3A:
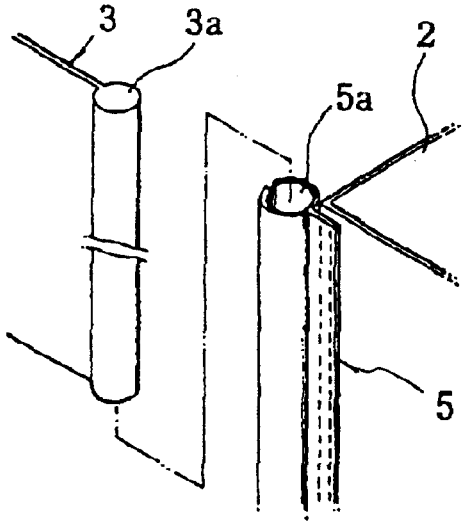
FIG. 3*a* illustrates a guide protrusion and a guide groove occupied in assembling and disassembling the hard case with the sack according to the present invention.
Figure 3B:
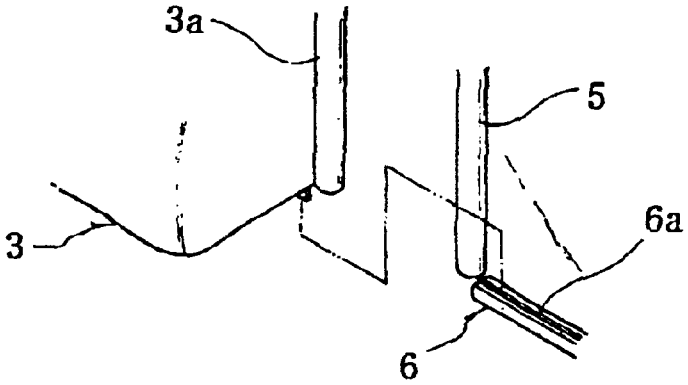
FIG. 3*b* illustrates the detachable hard case and a slide guide occupied in assembling and disassembling the hard case with the sack according to the present invention.
Figure 3C:
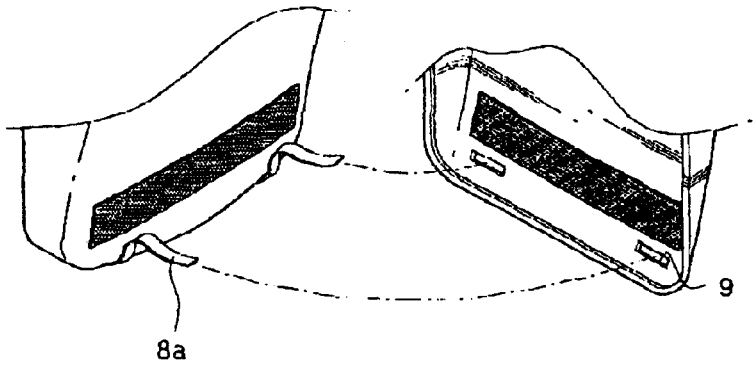
FIG. 3*c* illustrates a tape and a hole occupied in assembling and disassembling the hard case with the sack according to the present invention.

Referring to FIG. 1, FIG. 2*a* and FIG. 2*b*, the sack according to the present invention comprises a back supporter 1, a carry bag 2 to the backside of a back supporter 1, a hard case 3 and a combined connecter can be assembled or disassembled with each side of the carry bag 2. The combined connecter comprises a guide protrusion and a guide holder.

At least more than one guide protrusion 3*a* are prepared in each end side of the hard case 3 to assemble and disassemble the hard case 3 with the sack easily. A cross sectional area of both end sides of the guide protrusion 3*a* is larger than that of any other parts of the guide protrusion 3*a*. A guide holder 5 having a guide groove 5*a* is prepared in both end sides of the carry bag 2 and is inserted by the guide protrusion 3*a* of the hard case 3.

Referring to FIG. 2*a*, the bottom side of the hard case 3 is slid into a slide holder 6 having a slide groove 6*a* in the bottom side of the carry bag 2.

Referring to FIG. 2*b*, the bottom side of the carry bag 2 has at least one tape 8*a* connected to the bottom side of the hard case 3. The hard case 3 has at least one hole 9 corresponding to the tape 8*a* of the carry bag 2 so that the tape 8*a* is put into the hole 9 to enhance the attaching strength between the carry bag 2 and the hard case 3. Velcro 5*c* can also be applied to the hard case 3 and to the backside of the front cover of the carry bag 2 to enhance an attaching strength between the hard case 3 and the carry bag 2.

A cylindrical pillar is easy to be produced for the guide protrusion 3*a* and the guide groove 5*a*. An angled pillar, for example, a triangular prism, or any irregular shaped one can also be prepared unless the guide function is influenced on.

The preferred embodiment of the present invention applies an elliptic cylinder to the guide protrusion 3*a* and to the guide groove 5*a*. In addition, the diameter of the upper end of the elliptic cylinder is larger than that of any other cross sectional area of the elliptic cylinder. The upper end of the elliptic cylinder has also a nailhead. The taped elliptic cylinder with a nailhead can fix and detach the hard case 3 more easily.

The sack with detachable hard case is used as a hard type sack when the hard case 3 is attached, and as an ordinary sack when the hard case is removed. The sack with detachable hard case according to the present invention provides the sack that can assemble and disassemble the hard case 3 easily.

Assembling the hard case 3 to the sack is in the following statements. At first, all of the guide protrusions 3*a* in both sides of the hard case 3 are inserted into the corresponding guide grooves 5*a* of the guide holder 5 in both sides of the carry bag 2, which results in connecting the hard case 3 to the sack. After jointing the hard case 3 with the sack, the tape 8*a* is put into the hole 9 to enhance the attaching strength between the carry bag 2 and the hard case 3. The other method is that the bottom of the hard case 3 is slid into the slide groove 6*a* of the slide holder 6 in the bottom of the carry bag 2. As a result, attaching the hard case 3 to the sack is completed. After assembling the hard case 3, at least more than one of the additional connecters of the hard case 3 are jointed with corresponding connecters in a cover 4, which results in the hard type sack.

An ordinary sack can also be prepared by disassembling the hard case 3 with the sack. The disassembling is in reverse of the assembling process. The hard case 3 is easily disassembled with the sack by pulling the end of the hard case 3 off the sack. Then, an ordinary sack is prepared.

Figure 4:
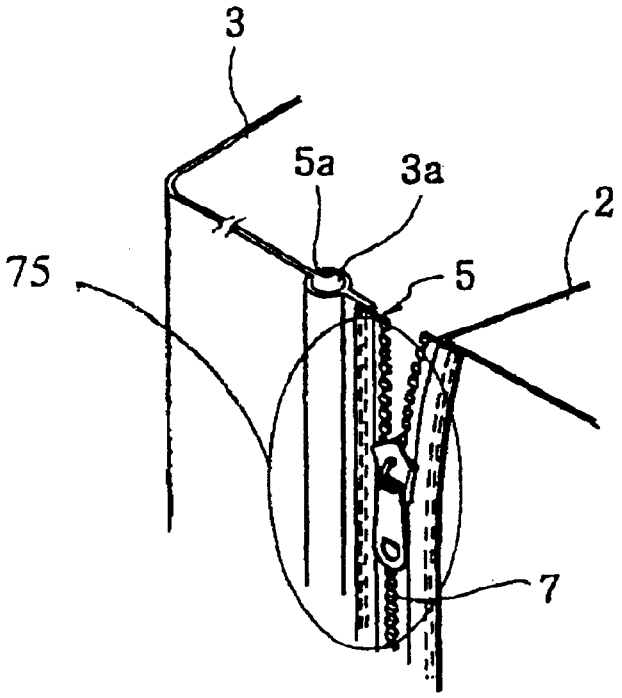
FIG. 4 illustrates another preferred embodiment of the present invention when another combined connecter is employed.

FIG. 4 is another preferred embodiment according to the present invention when another combined connecter is employed. A zipper 7 between the guide holder 5 and the carry bag 2 can easily assemble and disassemble the hard case with the sack instead of pulling off the hard case 3 from the sack. A combined connecter 75 comprising the guide holder 5, the guide protrusion 3*a* and the zipper 7, is an intermediate for connecting the carry bag 2 with the hard case 3. One side of the combined connecter 75 is fixed to the carry bag 2 by using the zipper 7 while the other side of the combined connecter 75 is fixed to the hard case 3 by using the guide holder 5. The zipper 7 can be replaced with sewing, bolting, or riveting. The zipper 7 can also be replaced with the protrusion-groove structure according to the present invention.

In addition, the guide groove 5*a* of the combined connecter 75 can be sewed while the guide protrusion 3*a* of the hard case 3 can not be sewed. Therefore, the material of the guide protrusion 3*a* is harder than that of the guide groove 5*a* when a sewing is employed to jointing the hard case 3 to the carry bag 2.

Figure 5:
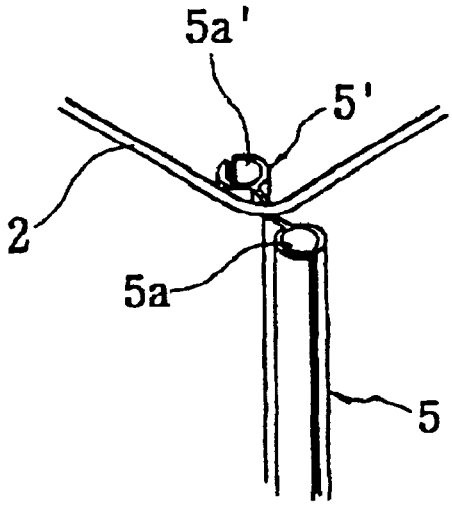
FIG. 5 illustrates more another preferred embodiment of the present invention when an inner guide holder is employed.

FIG. 5 is more another preferred embodiment according to the present invention. It is uncomfortable to carry the hard case 3 when the hard case 3 is separated from the sack. In this example, the hard case 3 is packed into the carry bag 2 so that the hard case 3 is carried more easily when the hard case 3 is separated.

An inner guide holder 5' with an inner guide groove 5*a*' is prepared in both inner sides of the carry bag 2. After separating the hard case 3 from the sack, the guide protrusion 3*a* of the hard case 3 is inserted into the inner guide groove 5*a*'. Then, the separated hard case 3 is put into the carry bag 2 and fixed to carry on easily.

The hard case 3 can be changed easily to various shape and designs when the connecting method of the hard case 3 corresponds to the connection method of the carry bag 2. The sack according to the present invention can change the hard case 3 to another one. Therefore, various needs and favorites of a purchaser can be satisfied more easily because the purchaser can have a new sack by changing the hard case simply.

In addition, the carry bag 2 without a backside cover 5*b* can be used when the hard case 3 is employed. The carry bag 2 without the backside cover 5*b* is the simplest way to product the sack according to the present invention. Velcro 5*c* can also be applied to the hard case 3 and to the backside of the front cover of the carry bag 2 to enhance an attaching strength between the hard case 3 and the carry bag 2.

As described in the above mentioned statements, the present invention disclose the sack used in the ordinary sack and the hard type sack selectively according to the existence of the hard case 3. Therefore, the sack according to the present invention can satisfy some portions of various needs and favorites of purchasers, and assembling and disassembling the hard case 3 is performed easily.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A sack comprising:

a back supporter;

a carry bag attached to the back supporter;

a detachable hard case connected to two opposite sides of the carry bag;

a cover jointed with the detachable hard case; and a combined connecter including a guide protrusion and a guide holder, the guide protrusion disposed at sides of the detachable hard case and connected to the two opposite sides of the carry bag, and the guide holder disposed at the two opposite sides of the carry bag and having a guide groove for receiving the guide protrusion.

2. The sack according to claim 1, further comprising an inner guide holder with an inner guide groove in the carry bag.

3. The sack according to claim 2, wherein the guide protrusion is fixed to the inner holder of the carry bag.

4. The sack according to claim 1, wherein the combined connecter further comprises:

a slide holder in the bottom of the carry bag, having a slide groove connected with the bottom of the detachable hard case;

wherein the bottom of the detachable hard case is slid into the slide groove while the guide protrusion of the detachable hard case is inserted into the guide groove.

5. The sack according to claim 1, wherein the guide protrusion and the guide holder have a tapered shape such that cross sectional areas of the guide protrusion and the guide holder at respective first ends of the guide protrusion and the guide holder are larger than at opposite respective second ends.

6. The sack according to claim 1, wherein the carry bag comprises three sides.

7. A sack comprising:

a back supporter;

a carry bag attached to the back supporter;

a detachable hard case connected to two opposite sides of the carry bag;

a cover joined with the detachable hard case; and a combined connecter including a guide protrusion, a guide holder, and a zipper, the guide protrusion disposed at sides of the detachable hard case and connected to the two opposite sides of the carry bag, the guide holder disposed at the two opposite sides of the carry bag and having a guide groove for receiving the guide protrusion, and the zipper connecting the combined connecter to the carry bag.

8. The sack according to claim 7, further comprising an inner guide holder with an inner guide groove in the carry bag.

9. The sack according to claim 7, wherein the guide protrusion is fixed to the inner holder of the carry bag.

10. The sack according to claim 7, wherein the combined connecter further comprises:

at least one tape in the bottom of the carry bag; and at least one hole in the bottom of the detachable hard case, connected with the tape to attach the carry bag and the detachable hard case.

11. The sack according to claim 10, wherein velcro is used to enhance an attaching strength between the carry bag and the hard case.

12. The sack according to claim 7, wherein the guide protrusion and the guide holder have a tapered shape such that cross sectional areas of the guide protrusion and the guide holder at respective first ends of the guide protrusion and the holder are larger than at opposite respective second ends.

13. The sack according to claim 7, wherein the carry bag comprises three sides.

14. A sack, comprising:

a back supporter;

a carry bag attached to the back supporter; and a detachable hard case attached to the carry bag;

a first connection assembly for connecting the detachable hard case to an exterior of the carry bag;

a second connection assembly for connecting the detachable hard case to an interior of the carry bag;

wherein, the hard case covers the carry bag when connected to the exterior so as to protect contents stored in the carry bag from impact; and wherein, the hard case is stored in the carry bag when connected to the second connection assembly.

15. A sack comprising:

a back supporter;

a carry bag attached to the back supporter;

a detachable hard case connected to two opposite sides of the carry bag;

a cover jointed with the detachable hard case; and a combined connecter including a guide protrusion, a guide holder and a connecting means, the guide protrusion being in sides of the detachable hard case connected to the two opposite sides of the carry bag, the guide holder being in the two opposite sides of the carry bag and having a guide groove inserted by the guide protrusion, and the connecting means connecting the combined connecter to the carry bag.

16. The sack according to claim 15, wherein the connecting means of the combined connecter connects the combined connecter to the carry bag by sewing, bolting or riveting.

* * * * *